US010639527B2

(12) United States Patent
Nardini et al.

(10) Patent No.: US 10,639,527 B2
(45) Date of Patent: May 5, 2020

(54) CLEANING DEVICE

(71) Applicants: Douglas Nardini, Pueblo, CO (US); David Roecker, Pueblo, CO (US)

(72) Inventors: Douglas Nardini, Pueblo, CO (US); David Roecker, Pueblo, CO (US)

(73) Assignee: Douglas Nardini, Pueblo, CO (US)

( * ) Notice: Subject to any disclaimer, the term of this patent is extended or adjusted under 35 U.S.C. 154(b) by 0 days.

(21) Appl. No.: 15/882,373

(22) Filed: Jan. 29, 2018

(65) Prior Publication Data

US 2018/0250564 A1 Sep. 6, 2018

Related U.S. Application Data

(63) Continuation-in-part of application No. 14/829,462, filed on Aug. 18, 2015, now Pat. No. 9,878,226.

(60) Provisional application No. 62/038,633, filed on Aug. 18, 2014.

(51) Int. Cl.

| | |
|---|---|
| ***A46B 11/00*** | (2006.01) |
| ***A63B 57/60*** | (2015.01) |
| ***A46B 11/08*** | (2006.01) |

(52) U.S. Cl.

CPC ..... *A63B 57/60* (2015.10); *A46B 11/002* (2013.01); *A46B 11/08* (2013.01); *A46B 11/0041* (2013.01); *A46B 2200/3073* (2013.01)

(58) Field of Classification Search

CPC ..... A46B 11/002; A46B 11/0041
USPC ..... 401/152–167, 183, 184, 185, 186, 270; 215/12.1

See application file for complete search history.

(56) References Cited

U.S. PATENT DOCUMENTS

| | | | | |
|---|---|---|---|---|
| 3,223,289 | A * | 12/1965 | Bouet | A45D 40/00 222/209 |
| 5,156,479 | A * | 10/1992 | Iizuka | A45D 34/042 401/151 |
| 5,277,209 | A | 1/1994 | Olson | |
| 5,839,614 | A * | 11/1998 | Brown | B65D 47/2031 222/185.1 |
| 6,945,722 | B2 * | 9/2005 | Colburn | A46B 11/06 401/11 |
| 7,273,422 | B2 | 9/2007 | Vokey et al. | |
| 8,708,591 | B2 * | 4/2014 | Shepard, Jr. | B08B 1/00 401/123 |
| 2002/0148066 | A1 | 10/2002 | Bullis | |
| 2003/0127543 | A1 | 7/2003 | Rieger et al. | |
| 2009/0065607 | A1 | 3/2009 | Gardner et al. | |

(Continued)

OTHER PUBLICATIONS

"Streetwize Portable Power Washer," Go Outdoors, 2013, retrieved from http://web.archive.org/web/20130622035058/http://www.gooutdoors.co.uk.streetwize-portable-power-washer-p199662?#, retrieved on May 10, 2016, 1 page.

*Primary Examiner* — David J Walczak
*Assistant Examiner* — Joshua R Wiljanen
(74) *Attorney, Agent, or Firm* — Fisherbroyles, LLP; Craig W. Mueller

(57) ABSTRACT

A golf equipment cleaning device is provided wherein the cleaning device selectively expels a pressurized fluid that a golfer may use at any point on the golf course. A golfer may use a hand pump to pressurize a container that comprises a fluid. Then, the golfer may release the pressurized fluid through the end of a bristled brush such that the golfer may scrub a golf ball or golf club with a bristled brush and a pressurized fluid.

14 Claims, 22 Drawing Sheets

(56) References Cited

U.S. PATENT DOCUMENTS

| | | | |
|---|---|---|---|
| 2011/0091339 | A1 | 4/2011 | Huang |
| 2014/0083456 | A1 | 3/2014 | Ramsey et al. |

* cited by examiner

CLEANING DEVICE

This application is a continuation-in-part of U.S. patent application Ser. No. 14/829,462, filed Aug. 18, 2015, now U.S. Pat. No. 9,878,226, issued Jan. 30, 2018, which claims the benefit of U.S. Provisional Patent Application Ser. No. 62/038,633, filed Aug. 18, 2014, the entire disclosures of which are incorporated by reference herein.

FIELD OF THE INVENTION

Embodiments of the present invention are generally related to cleaning devices. One embodiment of the present invention is used to clean golf equipment, such as golf clubs and golf balls.

BACKGROUND OF THE INVENTION

The modern game of golf originated in Scotland during the 15th century. Today, the sport enjoys massive popularity from children and casual players to professional golfers who compete for multi-million dollar payouts. Modern golf equipment includes an array of golf balls, clubs, bags, shoes, etc. Originally, golf balls were hard wooden spheres, then by the 17th and 18th centuries golf balls progressed to stuffed leather pouches. Modern golf balls first appeared in the early 19th century in the form of wound rubber balls. Inventors also discovered that placing dimples on the ball improved the trajectory of the golf ball by reducing drag the golf ball experiences during flight. The dimples also improve golf ball spin and control. Modern golf balls may include 250-450 dimples. The dimples and the golf ball must remain clean for the golf ball to function as designed.

Golf clubs have also developed since the emergence of modern golf in 15th century Scotland. Originally, golf clubs were made entirely from wood. Development of the golf club has produced clubs with metal heads and graphite shafts. Development of the golf club has also produced specialized features such as grooved heads. Club head grooves or scores allow a golfer to put more spin on the golf ball or channel water and debris away from the club face. A golf club with grooves on the club face is described in greater detail in U.S. Pat. No. 7,273,422, which is incorporated in its entirety by reference herein. After using a golf club in the rough, creating a divot in the ground, or shooting from a bunker, the club face may accumulate dirt and debris in the club face grooves. The debris can reduce the spin effect the grooves impart on the ball, or reduce the ability to channel dirt and debris from the club face, which reduces the club's effectiveness.

Dirt and debris can also impact golf ball effectiveness. Sand bunkers, water hazards, roughs with tall grass, etc. may cause dirt and debris to accumulate in the golf ball dimples, which adversely affects golf ball aerodynamics. Therefore, golfers frequently need to clean their golf balls to maintain the flight characteristics of the golf ball.

Golf courses often provide upright golf ball washers stationed periodically throughout a golf course, often at the beginning of a hole near the tee box. Golf ball washers comprise a closed chamber with brushes and cleaning solution. An agitator assembly is disposed through the closed chamber and comprises an aperture. A golfer places a dirty golf ball in the aperture of the agitator assembly, then reciprocates the agitator assembly such that the golf ball travels into the closed body and is cleaned by the brushes and cleaning solution. While upright golf ball cleaning machines can clean golf balls, they are usually only stationed at a few locations on a golf course, typically near the tee boxes. However, golf balls can become dirty at any point on the golf course; e.g., a golfer can slice a ball into a sand bunker or rough grass at any point. It is impractical to post upright golf ball cleaners at every location where a golf ball may become dirty. Further, the brush and cleaning solution combination is not necessarily efficient when cleaning a golf ball because a golf ball may comprise 250-450 dimples. A given dimple would need to encounter several brush bristles at multiple angles. More importantly, course operators rarely change the cleaning solution in the cleaners. Thus, golfers sometimes clean their golf equipment with spit or employ other unsanitary practices, which can later contaminate the cleaning solution and the golf balls cleaners.

A golfer often carries items to clean his golf balls or clubs during play. For example, a golfer may carry a rag to wipe down a dirty golf ball. However, a rag is not efficient in cleaning out individual dimples on a golf ball, and a golfer will either have to interrupt play to clean each dimple on a golf ball or accept a dirty golf ball with inferior flight characteristics. Further, rags are rarely cleaned and golfers use spit to wet the rags, which is not sanitary.

The options for cleaning a golf club face, specifically the grooves on the club face, are even fewer than the options for cleaning a golf ball. Most golf courses do not have periodic stations for cleaning the grooves on a golf club face. Rather, a golfer must carry a brush for cleaning the club face. Further, the golfer must be careful not to use a wire-bristled brush so not to scratch or mar the club face.

Thus it is a long felt need to provide a golf equipment cleaning device that allows for easy cleaning of any piece of golf equipment. The following disclosure describes an improved golf equipment cleaning device that allows the user to clean golf equipment at any point on a golf course.

SUMMARY OF THE INVENTION

It is one aspect of some embodiments of the present invention to provide a golf equipment cleaning device that utilizes pressurized fluid to clean golf equipment. It is a further aspect of embodiments of the present invention to provide a portable golf equipment cleaning device.

It is one aspect of some embodiments of the present invention to provide a golf equipment cleaning device powered by a variety of power sources. In one embodiment, a hand pump is used to compress gas or liquid in a central chamber of the cleaning device. In other embodiments, a bicycle pedal is operatively connected to the cleaning device to drive a pump. In yet other embodiments, the cleaning device is associated with a pump operatively connected to the electric power source of a golf cart or any other electric system. This includes inductive electric systems wherein specialized pads may be on a golf cart or through a golf course, and the pads create an alternating electric field which powers the cleaning device. Some contemplated devices include a squeezable water bottle used to pressurize cleaning fluid.

It is another aspect of some embodiments of the present invention to provide a golf equipment cleaning device that may be utilized in a variety of locations. Embodiments of the present invention may be portable, semi-portable, or fixed to another device or the environment. Portable cleaning devices are self-contained and need not be physically connected to one or more external power sources; these embodiments include cleaning device powered by hand, solar, or induction power sources. Semi-permanent cleaning devices are largely self-contained but may be physically connected to an external power source, including power outlets, pedal-powered pumps, or hydraulic fluid lines. Finally, permanent cleaning devices are fixed in their location and are physically connected to one or more power sources.

It is one aspect of some embodiments of the present invention to provide a golf equipment cleaning device that may comprise a variety of differently shaped containers. In some embodiments, the container may be a conventional shape, such as a generally cylindrical vessel. In other embodiments, the container may be shaped to suit various purpose or environments. For example, a container may be shaped to conform to a portion of a golf cart or a golf bag to create a more stable interface between the container and the golf car or golf bag. One skilled in the art will appreciate other objects that a container may be contoured to provide an improved interface.

It is another aspect of some embodiments of the present invention to provide a golf equipment cleaning device that may entrain additional liquid or vapor into a pressurized stream of fluid. In some embodiments of the present invention, the container contains a fluid such as water. The container is pressurized such that the water is expelled as a fluid mist or vapor or combination thereof through a container outlet. At a downstream location, additional liquid or vapor may be entrained into the flow of the water to modify the characteristics of the water. In some embodiments of the present invention, a user may selectively entrain additional liquid or vapor into a pressurized stream of fluid via a valve, gates, selective connection, or other similar means typically used in the art.

It is a further aspect of some embodiments of the present invention to provide a golf equipment cleaning device that comprises various brush configurations. Some embodiments of the present invention comprise a single, general purpose brush. In other embodiments, the brush may be removable from the valve or hose to which it is connected, and the brush and its bristles may be configured for specialized applications. For example, one brush may be configured to clean a golf ball while another brush may be configured to clean a golf club.

It is an addition aspect of various embodiments of the present invention to provide a golf equipment cleaning device that may be used as a misting device for a variety of purposes. Similar to other embodiments described herein, a mister may be used to clean objects that have an accumulation of dirt and debris. In further embodiments, a mister may cool a person on a hot day, to increase the humidity of a closed space, etc.

The Summary of the Invention is neither intended nor should it be construed as representing the full extent and scope of the present invention. Moreover, references made herein to "the present invention" or aspects thereof should be understood to mean certain embodiments of the present invention and should not be construed as limiting all embodiments to a particular description. The present invention is set forth in various levels of detail in the Summary of the Invention and in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken with the drawings.

BRIEF DESCRIPTION OF THE DRAWINGS

The accompanying drawings, which are incorporated in and constitute a part of the specification, illustrate embodiments of the invention and with the general description of the invention given above and the detailed description of the drawings given below, explain the principles of these inventions.

Figure 1:
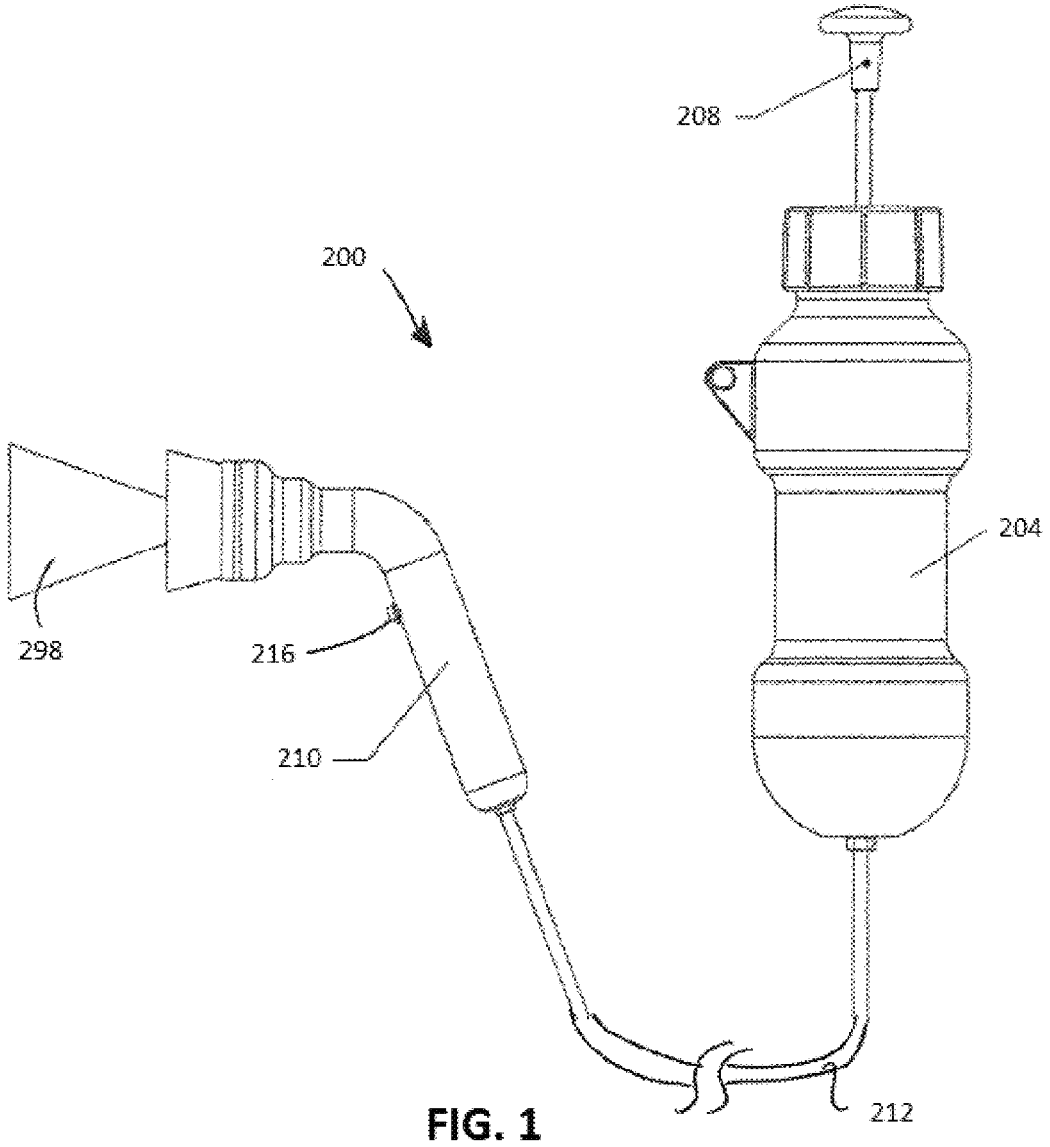
FIG. 1 is a front elevation of a cleaning system of one embodiment of the present invention.

To assist in the understanding of the embodiments of the present invention the following list of components and associated numbering found in the drawings is provided herein:

| No. | Component |
|---|---|
| 200 | Cleaning System |
| 204 | Bottle |
| 208 | Pump |

-continued

| No. | Component |
|---|---|
| 210 | Sprayer Assembly |
| 212 | Hose |
| 216 | Valve Button |
| 220 | Bottle Portion |
| 224 | Inner tube |
| 228 | Piston |
| 232 | Piston Head |
| 236 | Member |
| 240 | Inner Surface |
| 244 | Air Vents |
| 248 | Valve |
| 252 | Seal |
| 256 | Upper End |
| 260 | Cap |
| 264 | Fitting |
| 268 | Handle |
| 272 | Hose |
| 276 | Valve |
| 280 | Fitting |
| 284 | Member |
| 288 | Nozzle |
| 292 | Brush Holder |
| 296 | Bristles |
| 297 | Opening |
| 298 | Fluid |
| 300 | Cleaning System |
| 304 | Bottle |
| 308 | Brush |
| 310 | Cap |
| 312 | Valve |
| 316 | Golf Ball |
| 320 | Rigid Bottle |
| 324 | Sleeve |
| 328 | Pump Valve |
| 332 | Cover |
| 336 | Ridges |
| 340 | Scrapper |
| 400 | Cleaning System |
| 404 | Bottle |
| 408 | Brush |
| 410 | Cap |
| 412 | Valve |
| 416 | Sleeve |
| 420 | Groove |
| 424 | Rib |
| 428 | Carabiner |
| 432 | Retainer |
| 436 | Ring |
| 440 | Clip |

It should be understood that the drawings are not necessarily to scale. In certain instances, details that are not necessary for an understanding of the invention or that render other details difficult to perceive may have been omitted. It should be understood that the invention is not necessarily limited to the particular embodiments illustrated herein.

DETAILED DESCRIPTION

As described below, various embodiments of the present invention include a cleaning device that provides a pressurized fluid. Embodiments of the present invention have significant benefits across a broad spectrum of endeavors. It is the Applicant's intent that this specification and the claims to be accorded a breadth in keeping with the scope and spirit of the described invention or inventions despite what might appear to be limiting language imposed by referring to specific disclosed examples.

FIGS. 1-6 show another cleaning system 200 that employs some or all of the features of the embodiments described above. Here, a washer bottle 204 is provided that is pressurized by manual pump 208. The water bottle 204 is interconnected to a sprayer assembly 210 by way of a flexible hose 212. In operation, the bottle 204 is pressurized with the manual pump 210 and water or cleaning fluid is selectively expelled through the sprayer assembly 210 when a spray valve button 216 is depressed.

Figure 2:
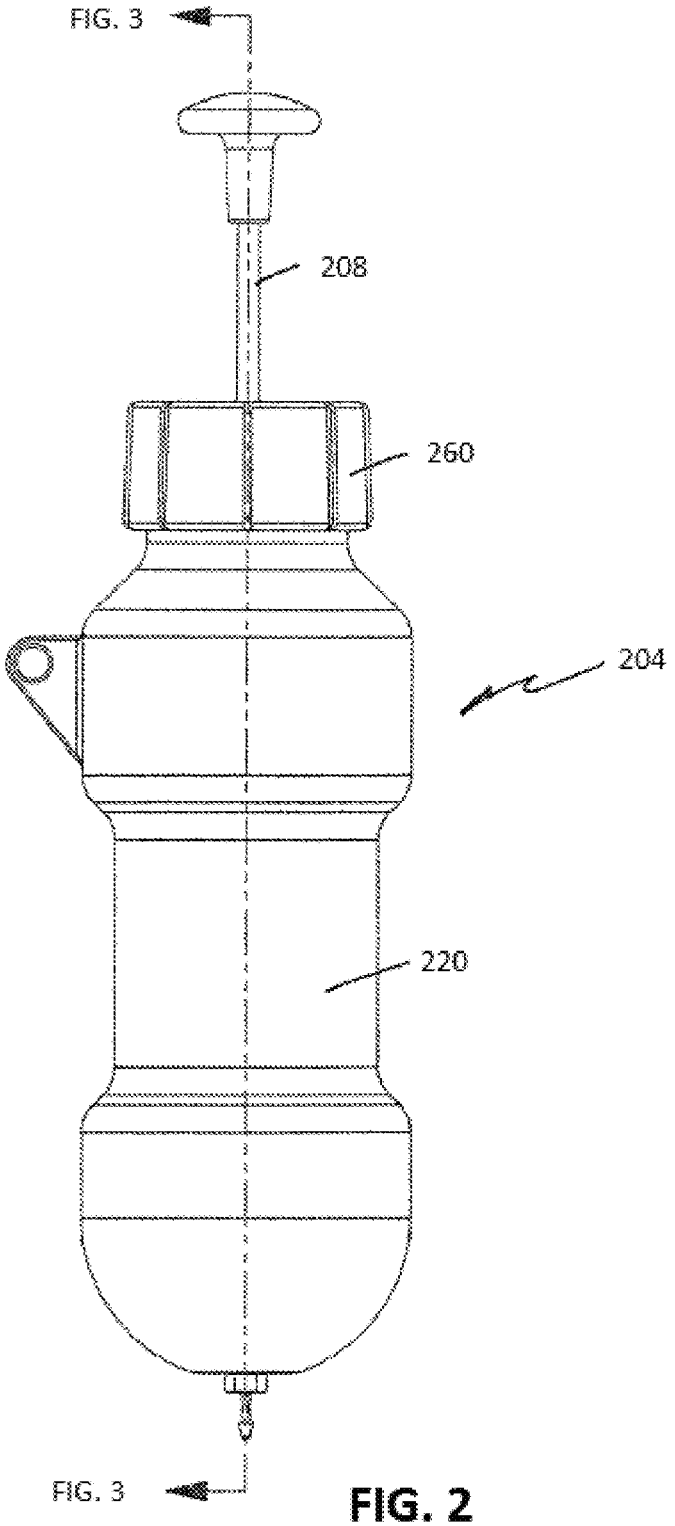
FIG. 2 is a front elevation view of a washer bottle used in the system of FIG. 1.
Figure 3:
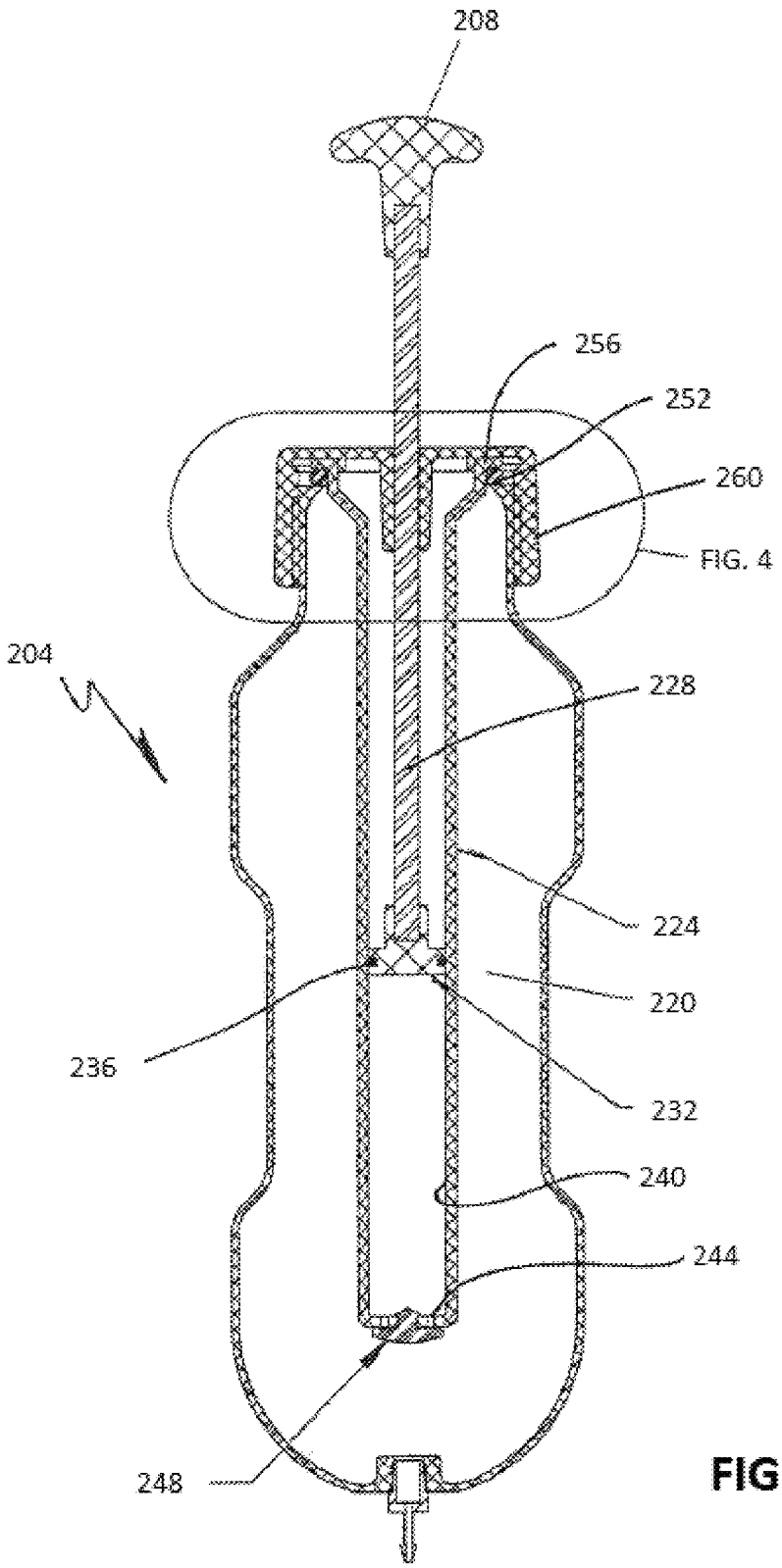
FIG. 3 is a cross-sectional view of FIG. 2.
Figure 4:
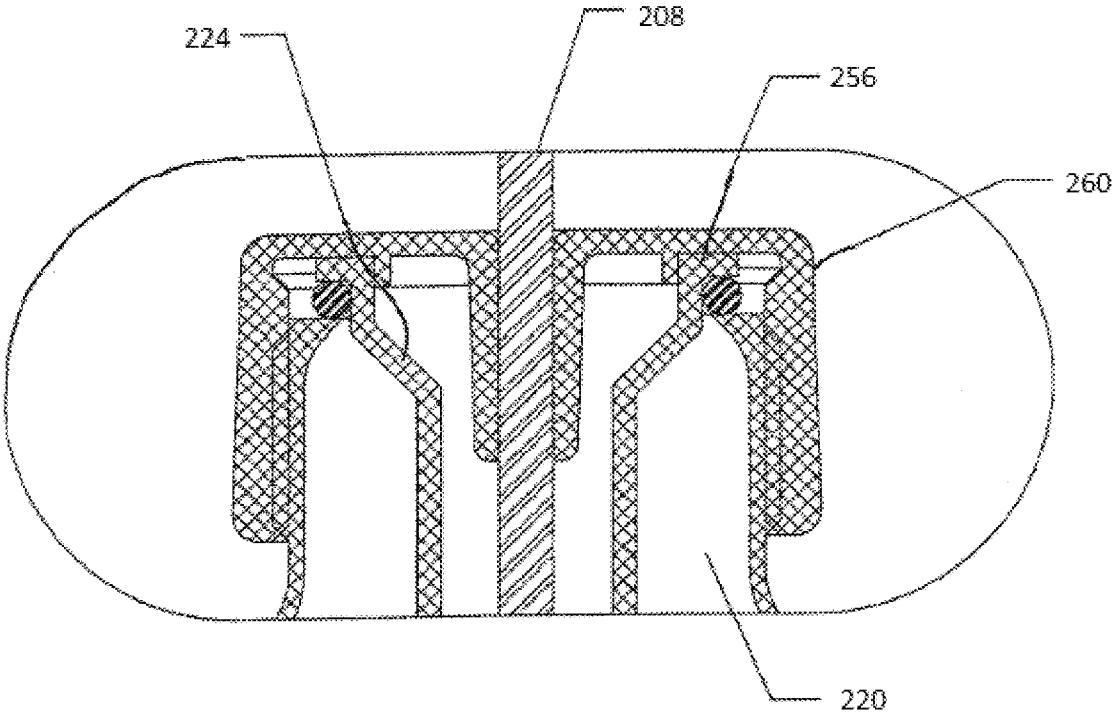
FIG. 4 is a detailed view of FIG. 3.

FIGS. 2-4 show the washer bottle 204 of one embodiment of the present invention. The washer bottle 204 includes a bottle portion 220 for storing water or cleaning fluid. An inner tube 224 is positioned within the bottle portion 220 and is adapted to operatively receive a piston 228. The piston 228 terminates at a piston head 232 that includes sealing member 236 that interfaces with the inner surface 240 of the inner tube 224. The inner tube 224 includes air vents 244 selectively blocked by a valve 248. The inner tube 224 is interconnected to the bottle portion 220 via a seal 252 that forms hermetically sealed system. More specifically, an upper end 256 of the inner tube 224 is in contact with a cap 260 that is threadingly engaged onto the bottle portion 220, which will be described in further detail below.

Referring now specifically to FIG. 4, an upper portion of the water bottle has threads that receive the cap 260. The cap 260 is designed to interface with threads of the bottle portion 220 to seal the same. However, the piston 228 associated with the pump penetrates the cap 260. Areas exterior to the inner tube 224 are hermetically sealed but the inner tube 224 can receive outside air used to pressurize the bottle portion.

In operation, the pump 208 is driven downwardly such that the piston head 232 moves closer to the end of the inner tube 224. Air trapped within the inner tube 224 is pressurized and can escape the air vents 244 positioned at the end of the inner tube 224. The pressure with the inner tube must overcome the resistance provided by the valve 248 positioned at the end of the inner tube 224. In this embodiment, the valve 248 is an umbrella valve that selectively deforms when the pressure within the inner tube 224 increases above a predetermined level. After the pressurized air escapes the inner tube 224, the interior volume of the bottle portion 220 is pressurized and, thus, is able to pressurize fluid in the flexible hose 212. Upon depression of the spray valve button 216, pressurized fluid escapes the sprayer assembly 210, similar to that described above. As the piston head 232 is pulled away from the bottle portion 220, the piston head 232 will move away from the end of the inner tube 224, thereby reducing the pressure and allowing the valve 248 to close. Cycling of the pump 208 pressurizes the bottle portion 220 or helps maintain the pressure within the bottle portion 220.

Figure 5:
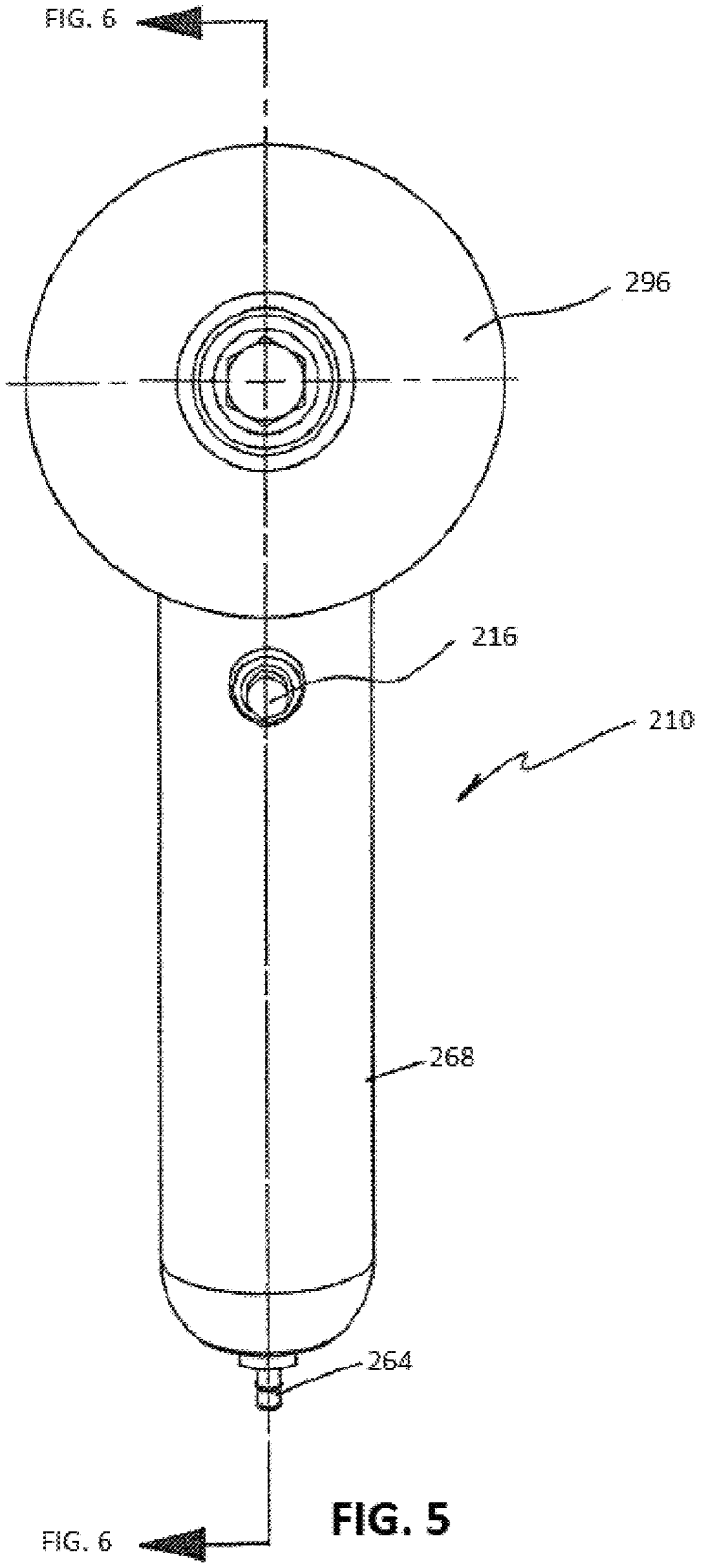
FIG. 5 is a side elevation view of a brush assembly employed by the system of FIG. 1.
Figure 6:
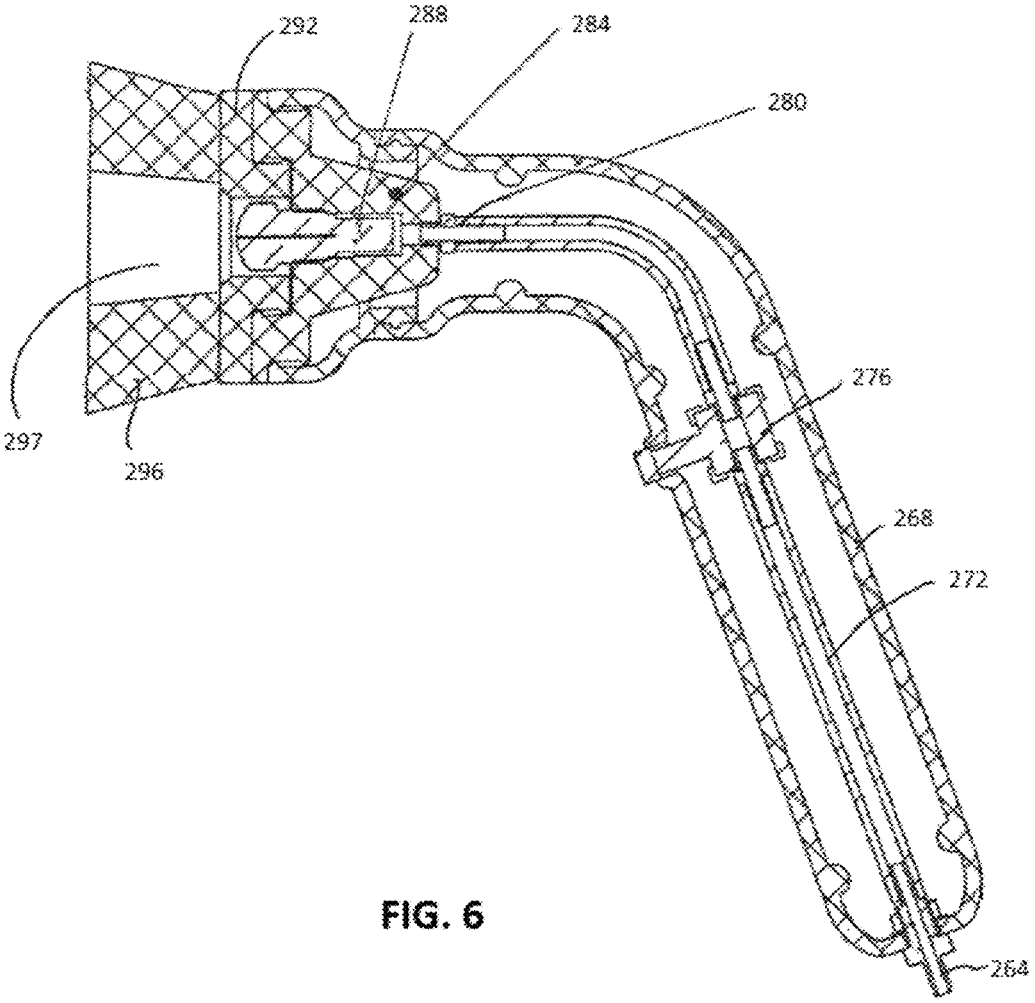
FIG. 6 is a cross-sectional view of FIG. 5.

FIGS. 5 and 6 show the sprayer assembly 210 of one embodiment of the present invention. The sprayer assembly 210 has a fitting 264 adapted for interconnection to the hose. The fitting 264 is interconnected to a handle 268 that provides an ergonomic gripping surface. A hose 272, which is associated with a valve 276, delivers fluid from hose 212. The valve 272 is selectively actuated by the valve button 216. A second fitting 280 is provided that is interconnected to an inner member 284 that secures a spray nozzle 288. One of ordinary skill in the art will appreciate that the nozzle 288 may be selectively adjustable such that the amount and nature of spray exiting the sprayer assembly 210 can be altered. Finally, a brush holder 292 and associated bristles 296 are provided that includes an opening 297 that accommodates fluid 298 exiting the spray nozzle 288.

In operation, when the fluid within the system is pressurized, the valve button 216 is depressed, which opens the valve 276 positioned within the handle 268, and allows pressurized fluid to communicate with the spray nozzle 288. Fluid 298 is then projected through the bristles 296 and onto the surface to be cleaned.

Figure 7:
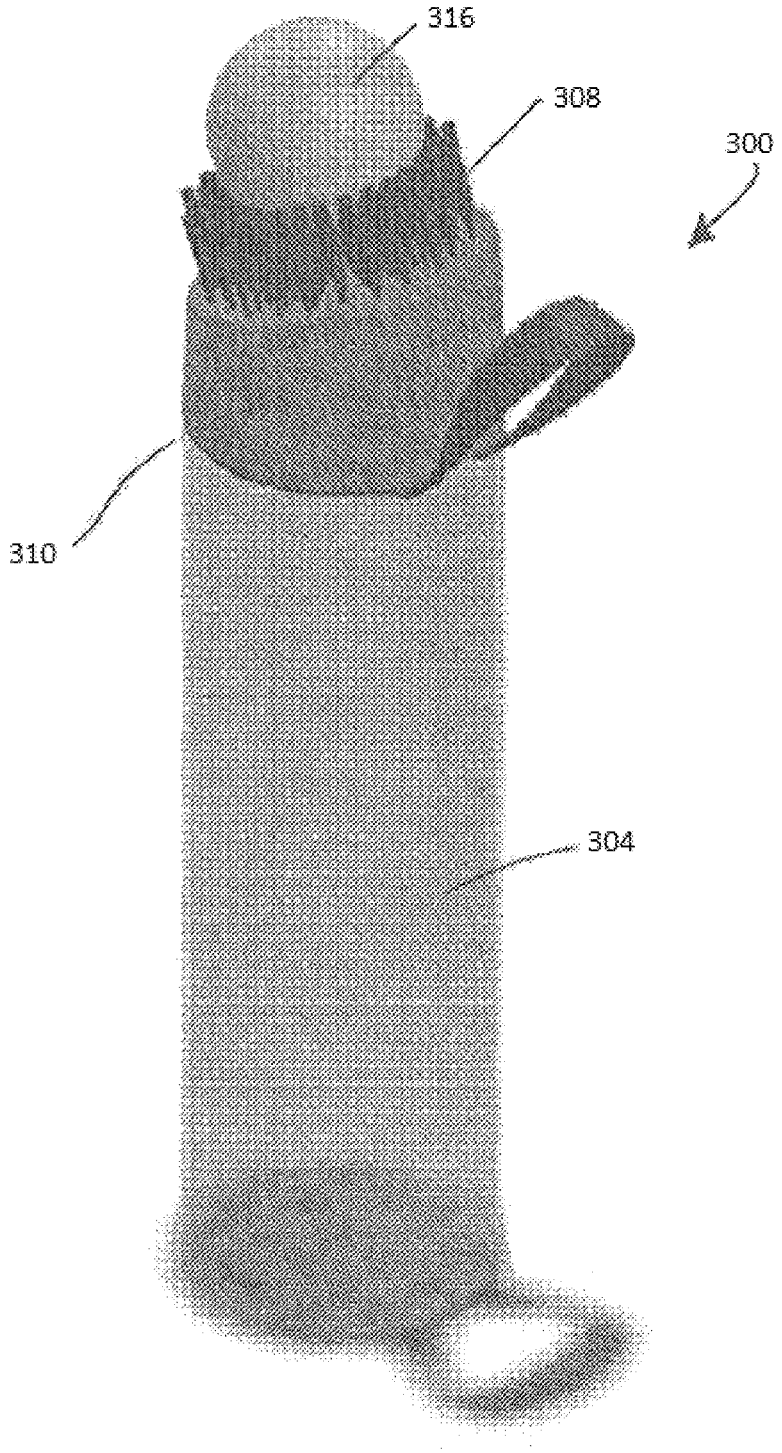
FIG. 7 is a perspective view of another embodiment of the present invention that utilizes a squeezable bottle.
Figure 8:
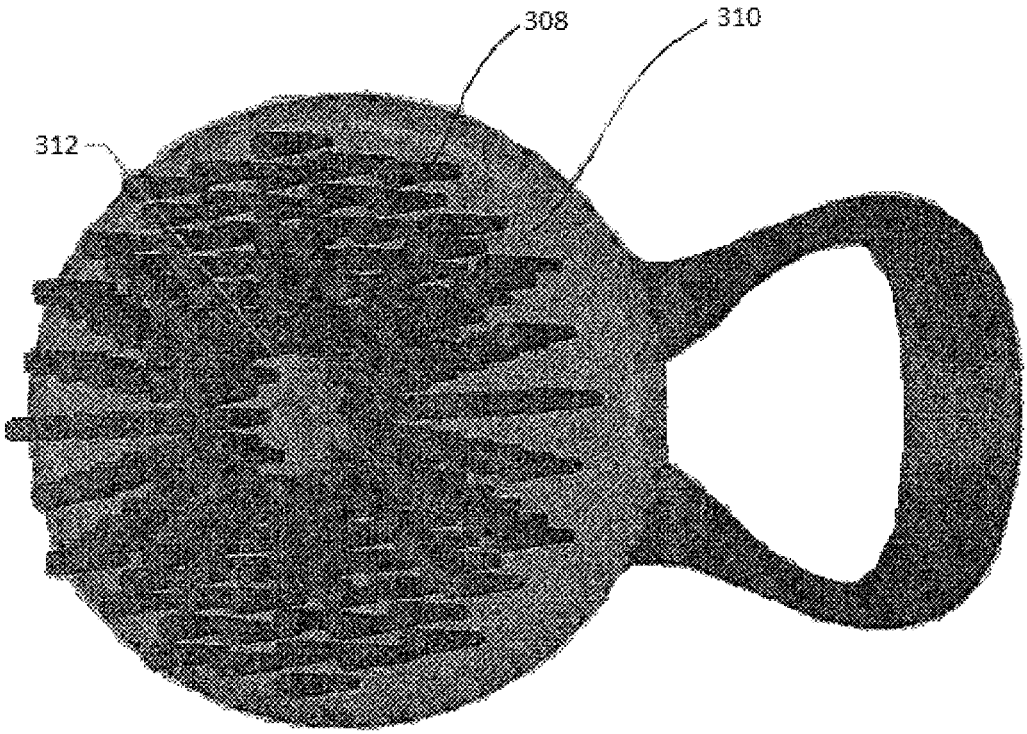
FIG. 8 is a top plan view of the embodiment shown in FIG. 7.

FIGS. 7 and 8 show another embodiment of a cleaning system 300 that employs a squeezable bottle 304, so a pump is not required. The squeezable bottle 304 holds water, cleaning fluid, or a combination thereof. The squeeze bottle 304 is sealed with a cap 308 that opens when the water or cleaning fluid is pressurized by squeezing the bottle. The water bottle may employ a lanyard so it can be secured to a golfer's bag or a golf cart.

In operation, a golf ball 316 or other golf related item, such as a club head, is placed in contact with the brush 308 and the bottle 304 is squeezed, which pressurizes the fluid within the bottle 304 to open the valve 312 to wet the item being cleaned or the brush 308.

Figure 9:
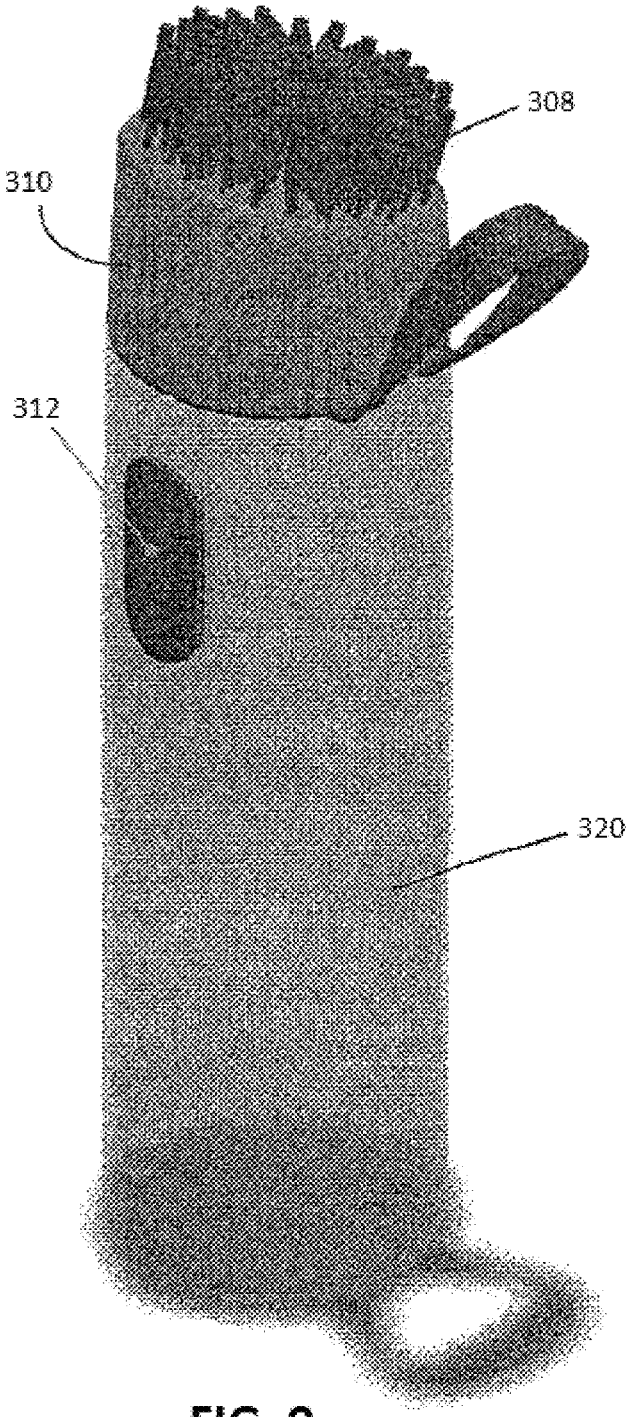
FIG. 9 is a perspective view of another embodiment of the present invention that includes a pump valve interconnected to a rigid bottle.
Figure 10:
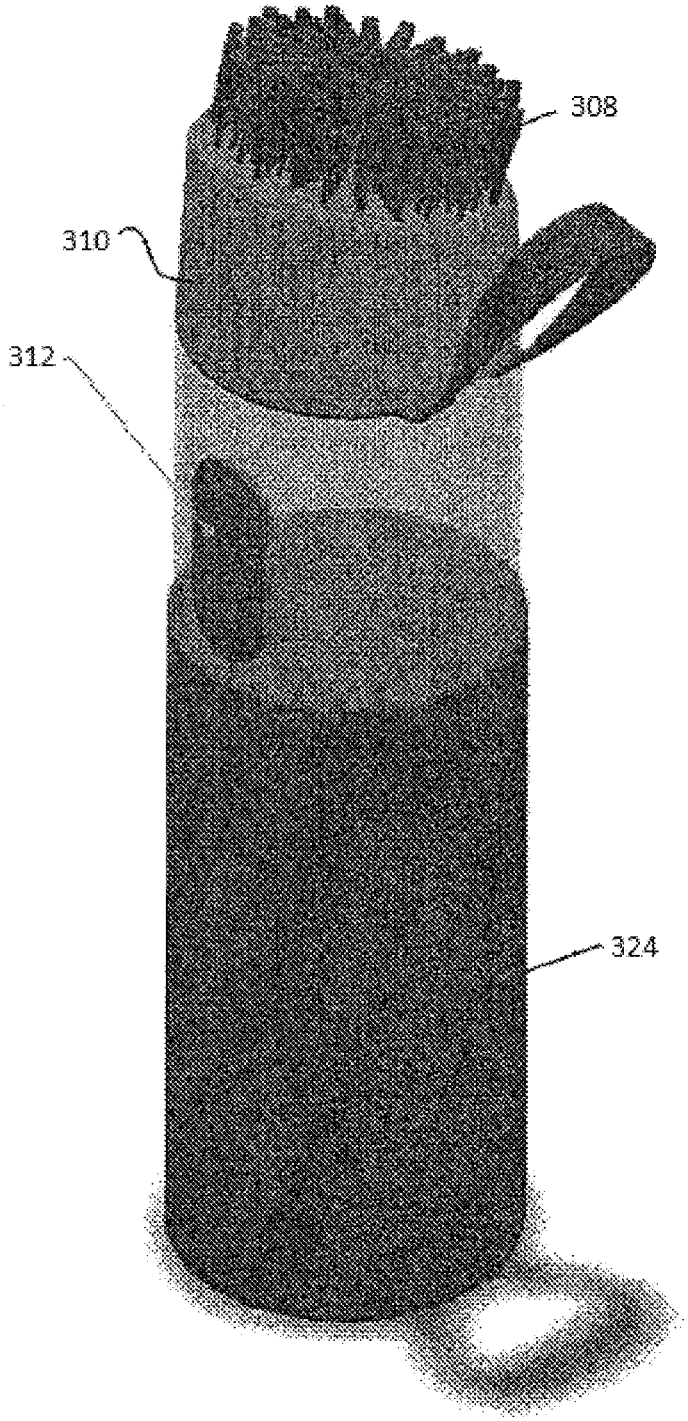
FIG. 10 is a perspective view of an embodiment similar to that shown in FIG. 9 that employs a sleeve.

FIGS. 9 and 10 show another embodiment similar to the embodiment of FIGS. 7 and 8. Here, however, a rigid bottle 320 is employed, which may be associated with a soft sleeve 324 that enhances gripping. A pump valve 328 is associated with an outer surface of the rigid bottle 320. The pump valve 328 can be interconnected to a hand pump and flexible hose as described in the embodiments disclosed above, or interconnected to other manual, hydraulic, or pneumatic pumps generally known in the art. The pump, regardless of its type or manufacture, allows the fluid within the rigid bottle 320 to be pressurized. That is, similar to the operation of the embodiments described above, this embodiment allows the user to selectively operate the pump valve 328 to pressurize the fluid within the rigid bottle 320. Fluid pressurization will open a valve 312 and expel fluid at a high pressure through the cap 310 and around the brush 308.

Figure 11:
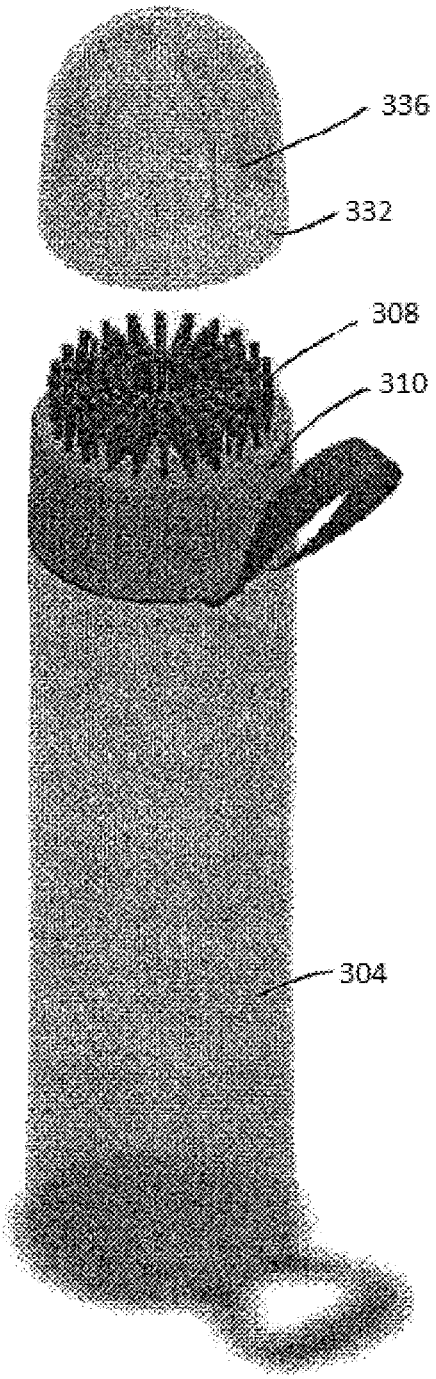
FIG. 11 is a perspective view of another embodiment of the present invention that employs a squeezable bottle adapted to clean a golf ball.
Figure 12:
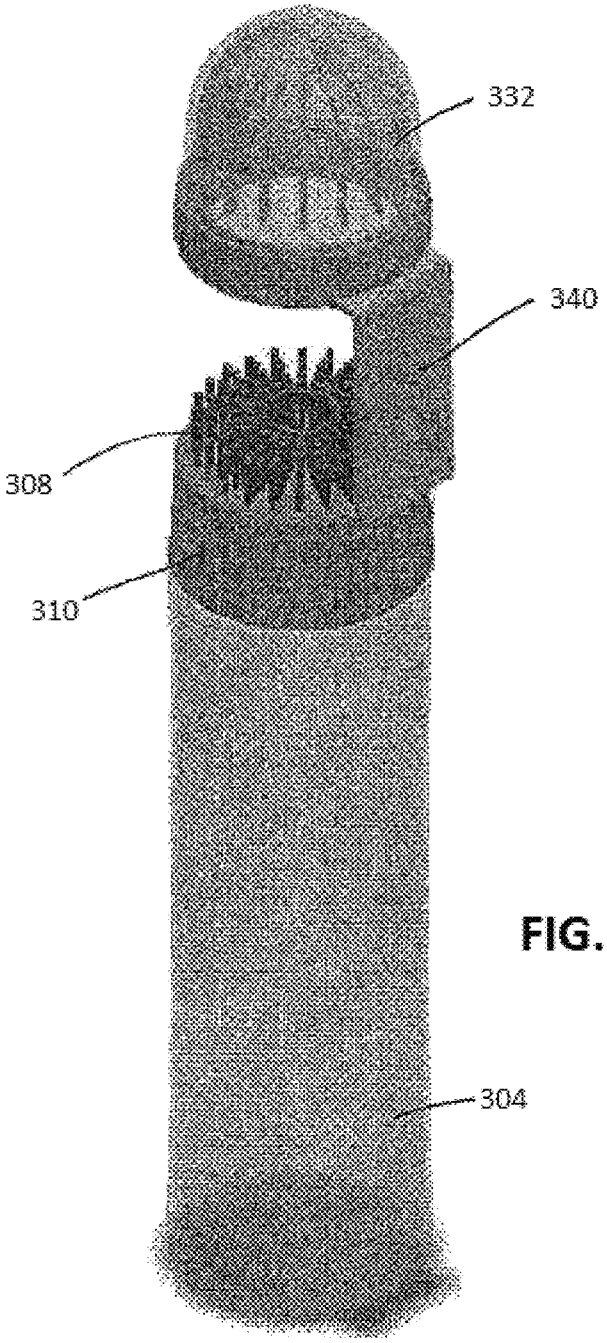
FIG. 12 is a perspective view of an embodiment similar to that shown in FIG. 11 that includes a scraper.
Figure 13:
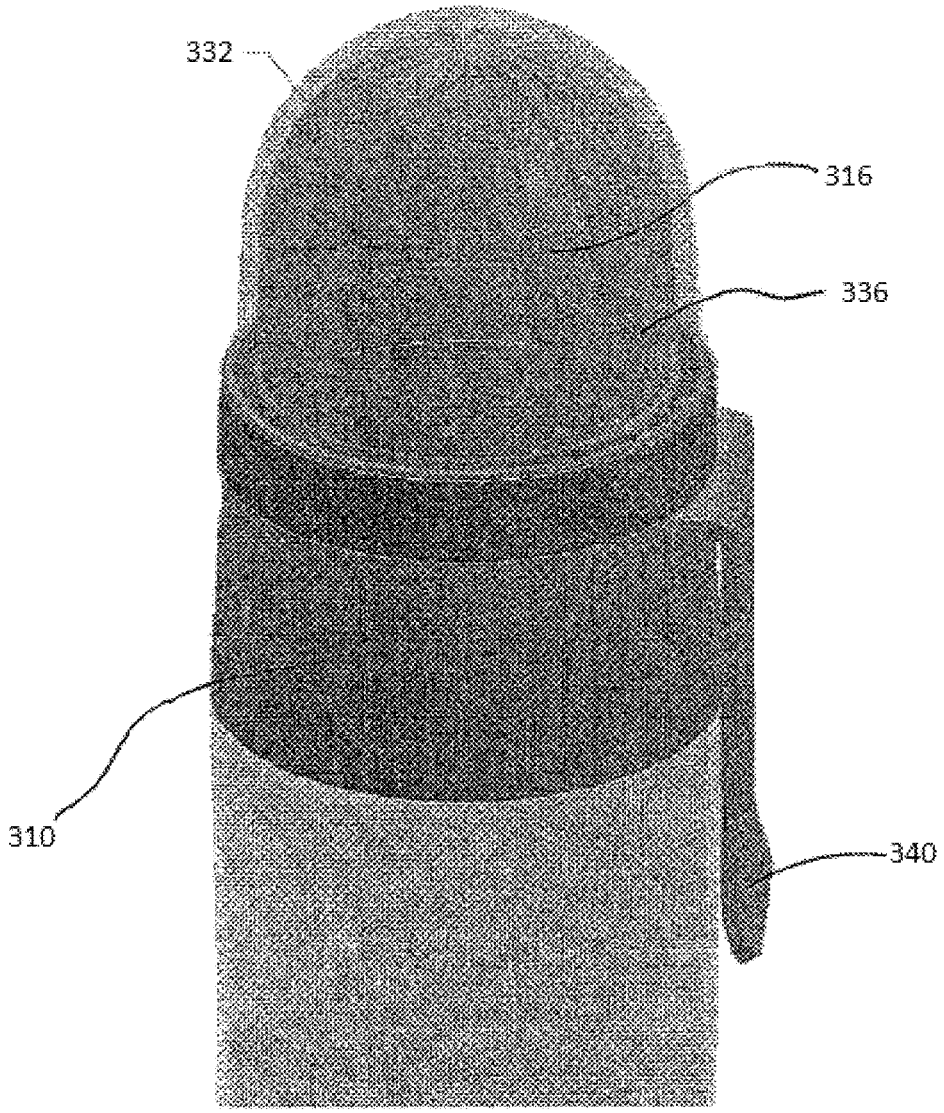
FIG. 13 is a detailed view of FIG. 12.

FIGS. 11-13 show yet another embodiment of the present invention that includes a cover 332 selectively interconnected over the cap 310. Here, the bottle can be rigid or squeezable, but in this example, the bottle 304 is squeezable. Thus this cleaning system operates similar to that of the embodiment shown in FIGS. 7 and 8. The cover 332 may have a plurality of ridges 336 extending from an inner surface thereof. As shown in FIG. 13 the ridges 336 help secure the golf ball 316 in a predetermined location such that when pressurized fluid exits the cap 310, the golf ball is washed effectively.

As shown in FIGS. 12 and 13, the cover 332 may also include a scraper 340 extending therefrom. The scraper 340 is used to remove large debris from a club head, for example. The scraper 340 may terminate at a point such that it can clean cleats or club head grooves. Furthermore, the scraper 340 may include a plurality of bristles (not shown) extending therefrom to provide yet another means to clean items wherein the user would hold the bottle 304 and use it as a brush handle.

Figure 14:
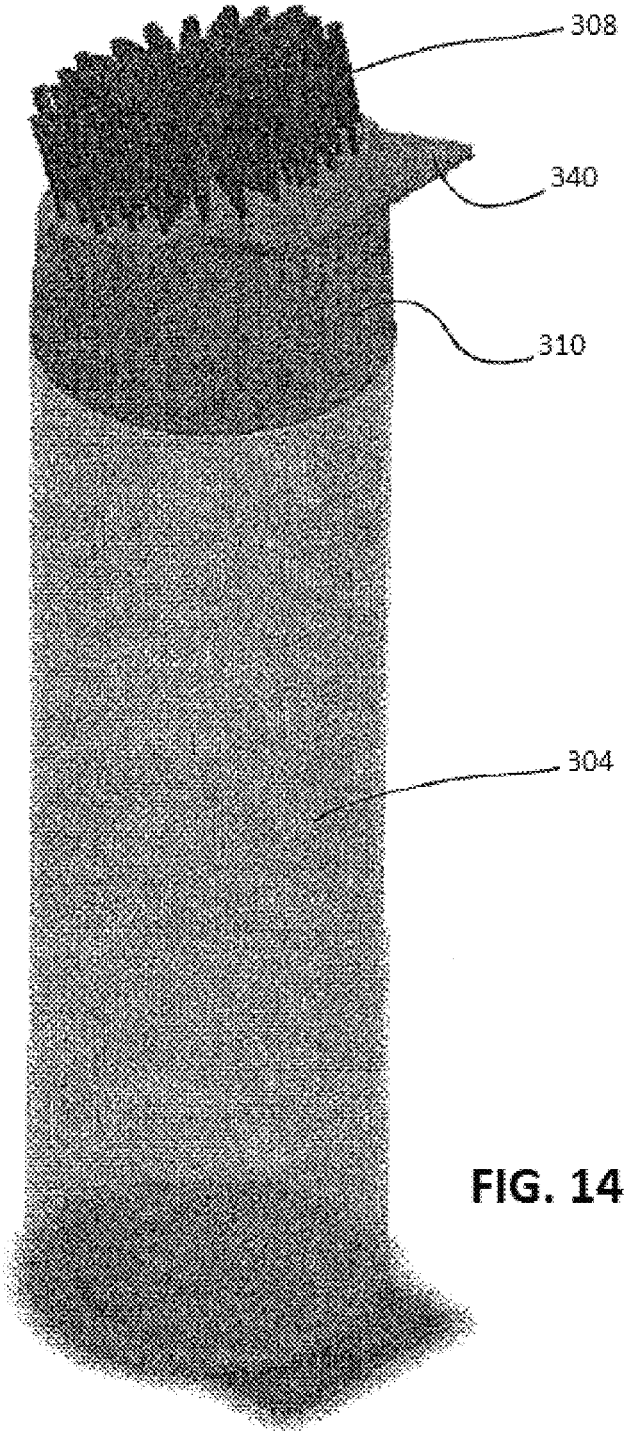
FIG. 14 is a perspective view of yet another embodiment of the present invention that has a cap with the scraper.
Figure 15:
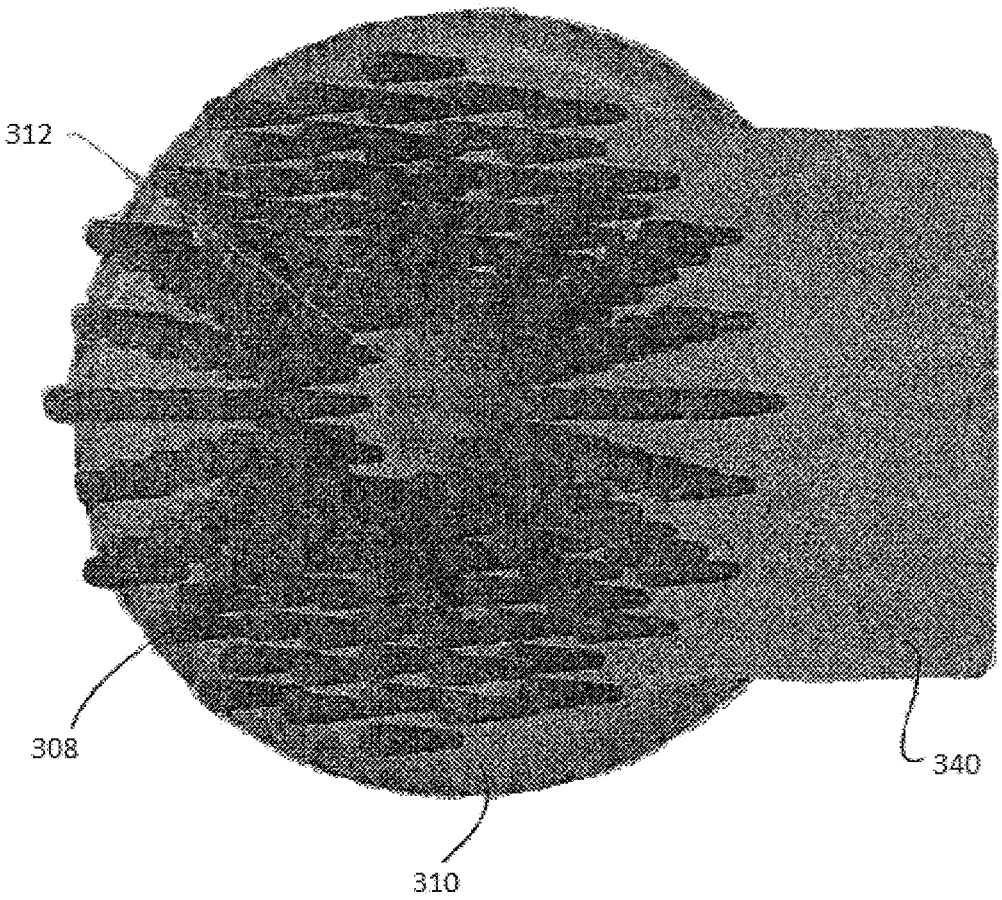
FIG. 15 is a top plan view of FIG. 14.
Figure 16:
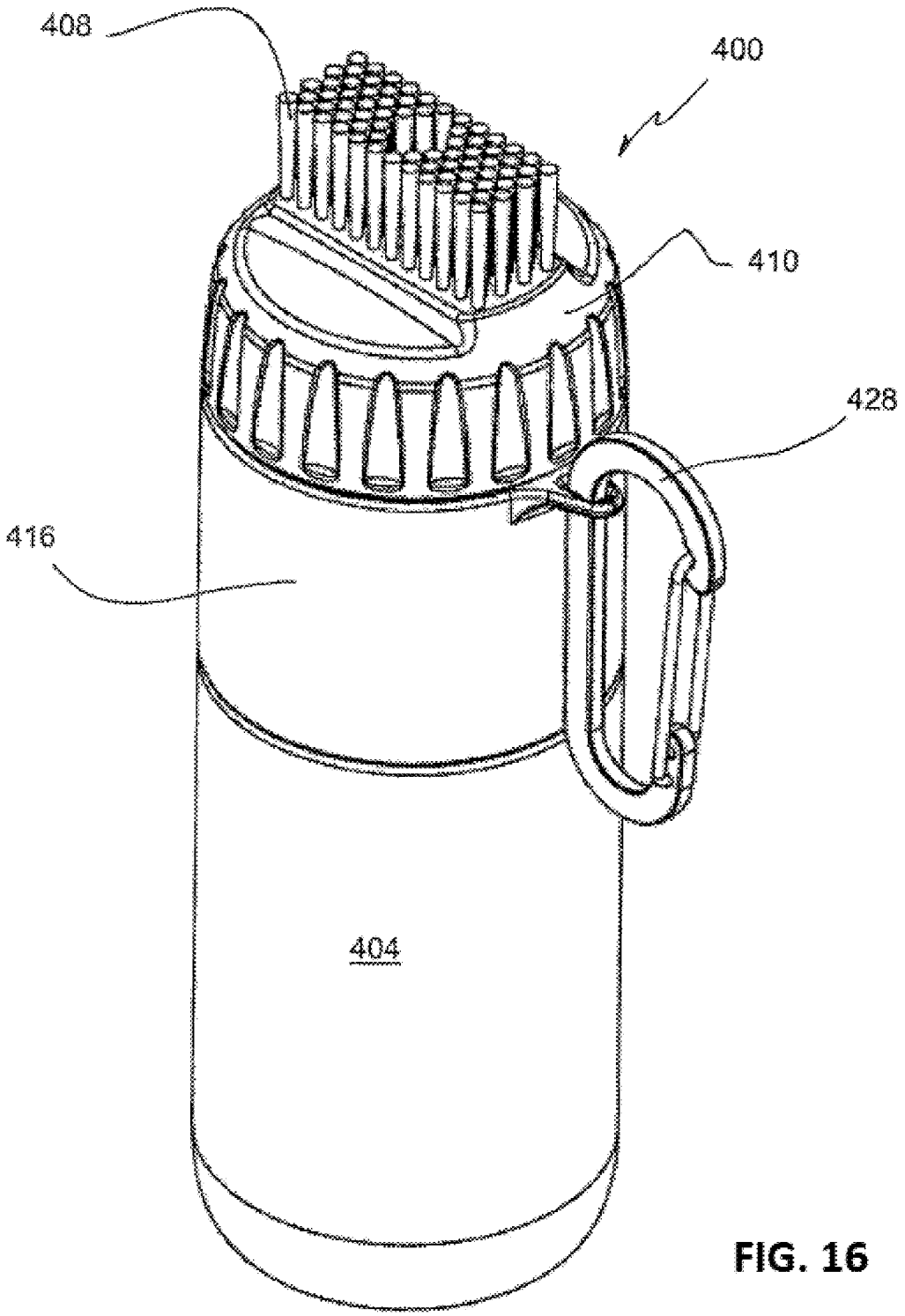
FIG. 16 is a perspective view of another embodiment of the present invention that employs a squeezable bottle.
Figure 17:
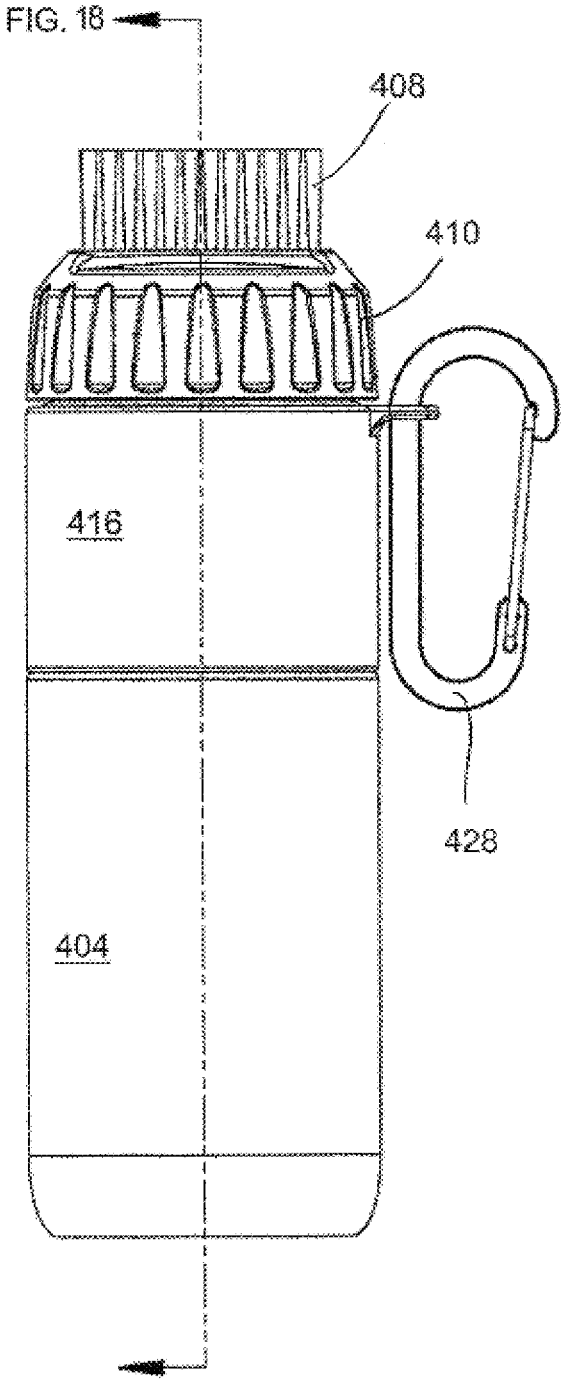
FIG. 17 is a side elevation view of the embodiment shown in FIG. 16.

FIGS. 14 and 15 show yet another embodiment of the present invention, wherein the cap 310 has an integrated scraper 340. Again, the scraper 340 allows for the cleaning system to be used in more ways, such as to remove large items from a club head. The scraper 340 may also include a downwardly extending portion somewhat like the scraper shown in the previous figures. In this example, the downwardly extending scraper may have a plurality of bristles that are designed to remain dry and remove larger and stubborn debris from a club head. Thereafter, the item being cleaned could be exposed to the softer and wet bristles of the cap 310.

FIGS. 16-27 show a cleaning system 400 of another embodiment of the present invention. Similar to some of the embodiments described above, the cleaning system 400 includes a bottle 404 that is selectively sealed with a cap 410. The cap includes a plurality of bristles that form a brush 408 adapted to clean golf balls, golf clubs, etc. The cap may selectively receive a cover similar to that described with respect to FIG. 11. The bottle also includes a retainer 432 operably interconnected to a carabiner, for example, that is capable of interfacing with a golf bag, golf cart, etc. The retainer may be interconnected to a sleeve 416 that is operatively associated with the outside surface of the bottle 404.

Figure 18:
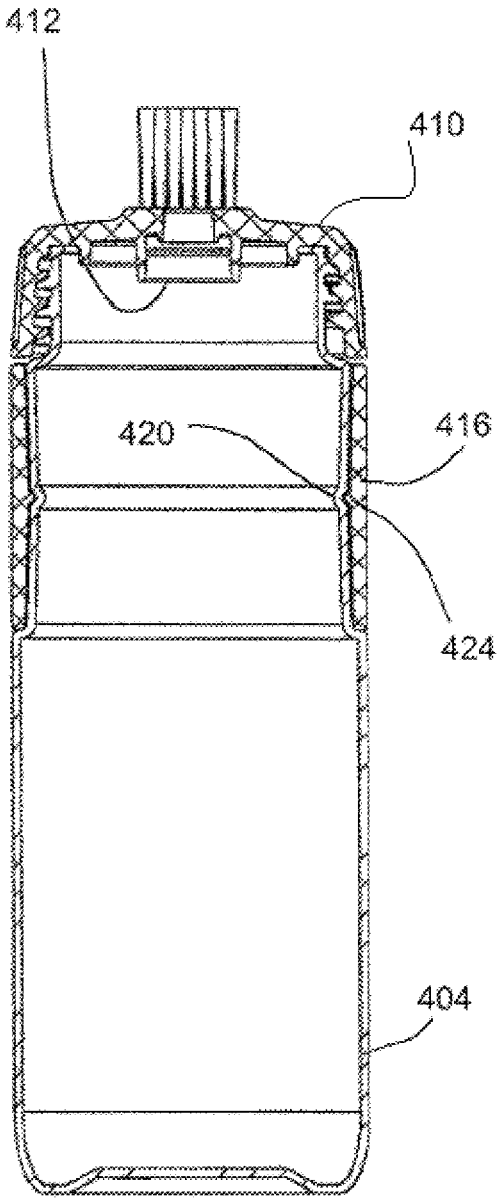
FIG. 18 is a cross-sectional view of FIG. 17.

FIG. 18 shows the components of one embodiment of the present invention in more detail. Here, the sleeve 416 includes an inwardly-extending rib 424 that is received within a groove 420 provided in the bottle 404. Interaction between rib 424 and groove 420 allows the sleeve 416 to rotate about the longitudinal axis of the bottle 404 while preventing disassociation of the sleeve 416 from the bottle 404. In another embodiment, the sleeve employs at least one inwardly-extending protrusion that interfaces with a corresponding indent on the bottle, wherein the sleeve is not capable of rotation. The cap 410 includes an opening associated with a valve 412 that selectively allows fluid to exit the cleaning system 400 when the bottle 404 is squeezed. As one of ordinary skill in the art will appreciate, the cap 410 is selectively interconnected to the bottle 404 by way of a threaded interconnection. Other common interconnection mechanisms may be employed without departing from the scope of the invention.

Figure 19:
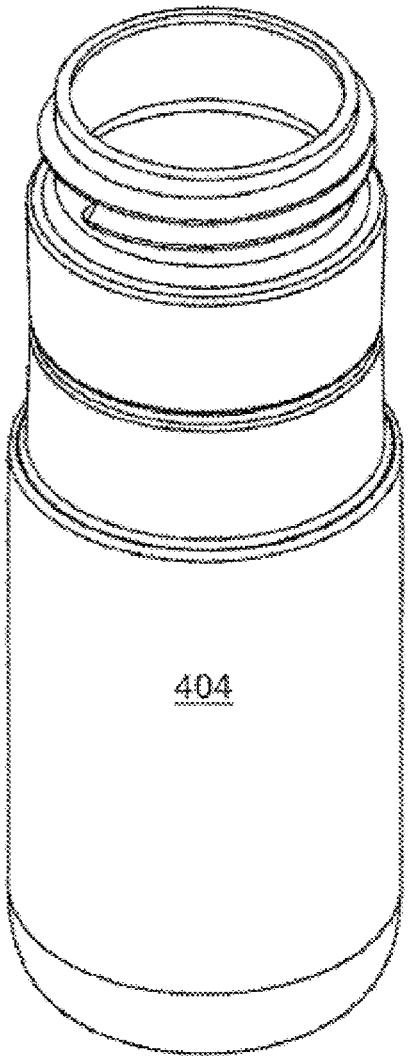
FIG. 19 is a perspective view of a squeezable bottle used with the embodiment shown in FIG. 16.
Figure 20:
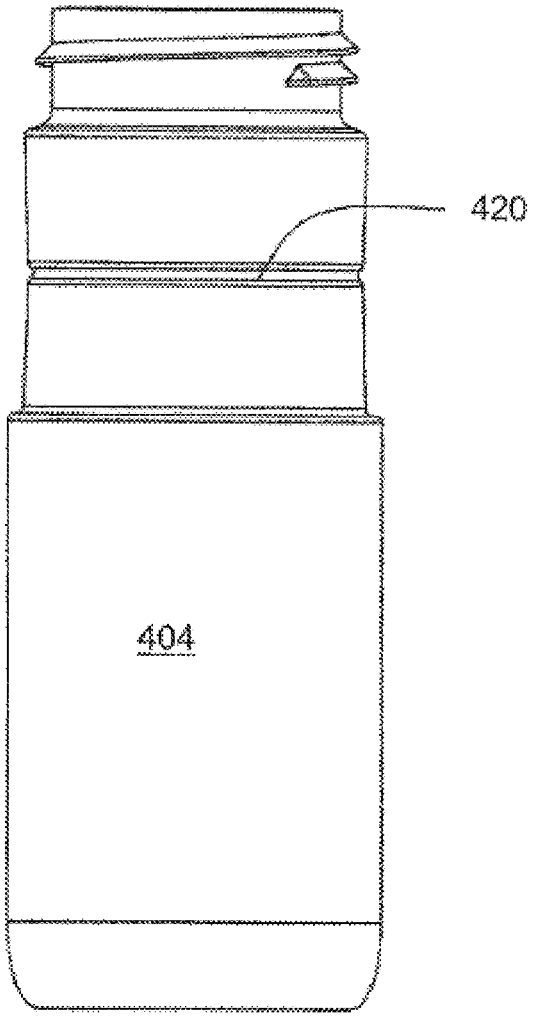
FIG. 20 is a side elevation view of the bottle shown in FIG. 19.
Figure 22:
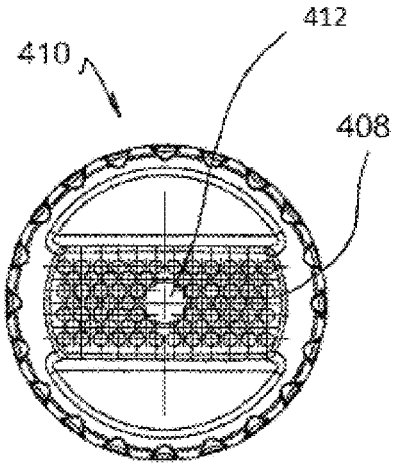
FIG. 22 is a top plan view of the cap and brush shown in FIG. 21.
Figure 21:
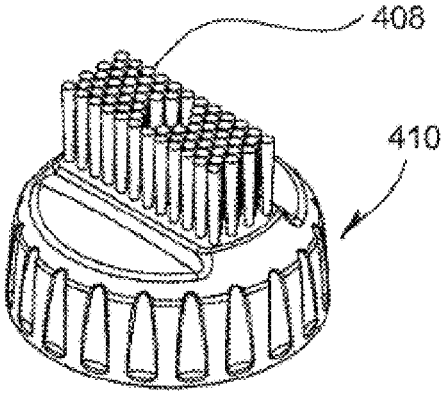
FIG. 21 is a perspective view of a cap and brush used with the embodiment shown in FIG. 16.
Figure 23:
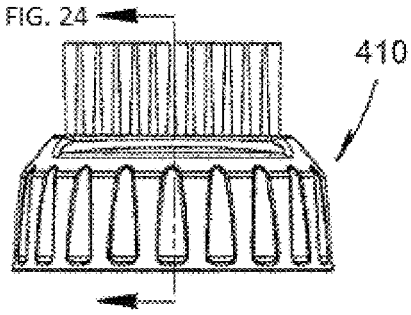
FIG. 23 is a side elevation view of the cap and brush shown in FIG. 21.
Figure 24:
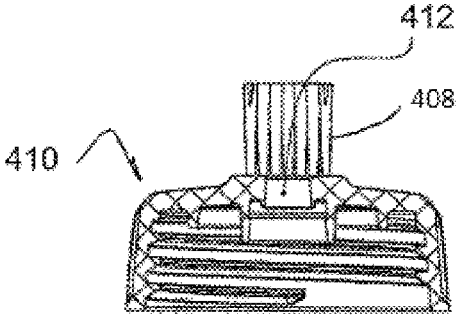
FIG. 24 is a cross-sectional view of FIG. 23.

FIGS. 19 and 20 show a bottle 404 of one embodiment of the present invention. Again, the bottle includes at its opening threads that selectively receive threads of the cap. The bottle may also include a recessed portion, i.e., a portion with reduced diameter compared to the outermost diameter of the bottle, designed to selectively receive the sleeve. The portion with reduced diameter includes the groove 420 adapted to selectively receive the corresponding rib of the sleeve. Those of ordinary skill in the art will appreciate that providing an outwardly-extending rib on the bottle that selectively seats within a groove in the sleeve may also be employed. The bottle 404 may include surface ornamentation/designs and need not be of a consistent outer diameter. The bottle of one embodiment of the present invention is blow molded low-density polyethylene (LDPE) or high-density polyethylene (HDPE).

FIGS. 21-24 show the cap 410 of one embodiment of the present invention that includes a plurality of bristles that form a brush 408. The cap 410 is selectively interconnected to a corresponding bottle by way of threaded interconnection. Tightening of the cap 410 may be aided by providing a plurality of indentations or ribs on the outer surface of the cap 410. The cap 410 includes a valve 412 that selectively opens when the internal pressure of the bottle and cap 410 exceed a predetermined level. An example of a suitable valve is the SureSnap® V21 valve sold by AptarGroup, Inc. described in U.S. Pat. Nos. 5,954,237, 5,839,614, and 5,934,512, which are incorporated by reference in their entireties herein. One valve embodiment described in these patents includes a marginal portion sealing about the cap opening, a head portion including a central area with an orifice that opens to permit fluid flow therethrough in response to a predetermined discharge pressure within the container, and closes to shut off fluid flow therethrough upon removal of the predetermined discharge pressure, and a generally J-shaped connector sleeve having a resiliently flexible construction with a first leg portion thereof connected with the marginal portion, and a second leg portion thereof connected with the head portion; the first and second leg portions being mutually oriented at an acute included angle, and joining one another at an arcuate portion which facilitates movement of the head portion when dispensing product from the container. One of skill in the art will appreciate that other valve designs described and claimed in the aforesaid patents may be employed without departing from the scope of the invention. The brush may include an opening in the bristles that accommodates the valve when it is in the open configuration.

Figure 25:
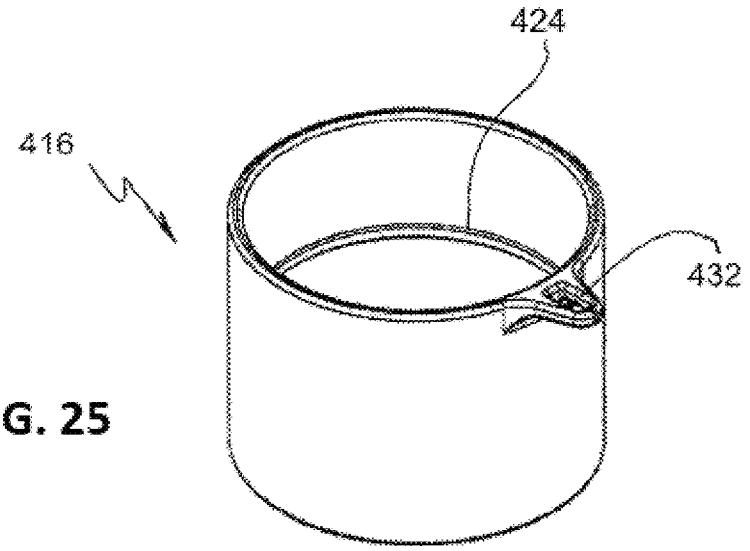
FIG. 25 is a perspective view of a sleeve used with the embodiment shown in FIG. 16.
Figure 26:
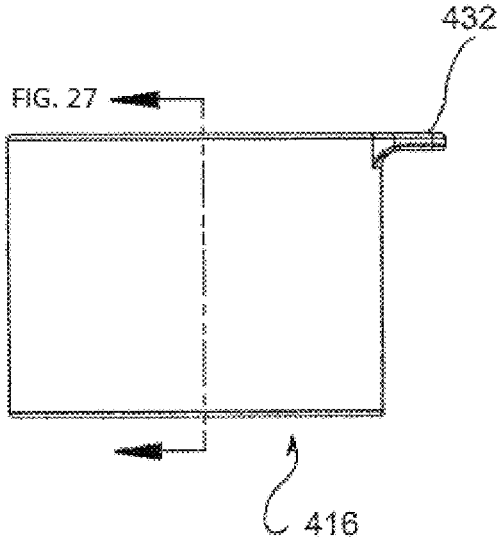
FIG. 26 is a side elevation view of the sleeve shown in FIG. 25.
Figure 27:
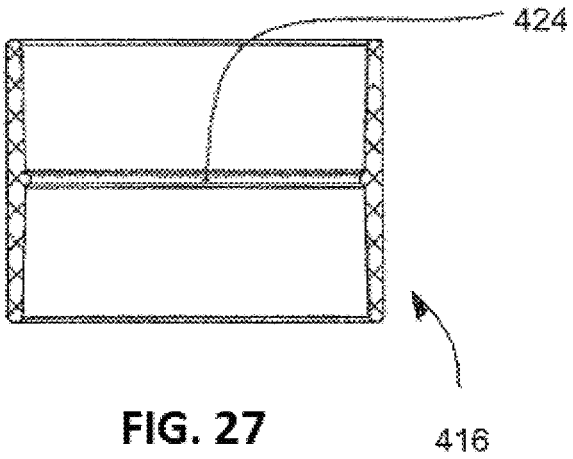
FIG. 27 is a cross-sectional view of FIG. 26.

FIGS. 25-27 show the sleeve 416 of one embodiment of the present invention that has an outwardly-extending retainer 432 capable of receiving a carabiner or other selectively interconnecting device. The sleeve 416 includes the inwardly-extending rib 424 as described above. The sleeve 424 of one embodiment snap fits onto the bottle. In one embodiment of the present invention, the sleeve 416 is adapted selectively receive indicia, such as ink. In some embodiments, the ink used on the sleeve would not be suitable to be used on the bottle because of its material manufacture—LDPE or HDPE—materials that are notoriously difficult to print on. Employing a printable sleeve is desirous as it allows the end user to use a specialized printer to add graphics and other indicia to the cleaning system.

Figure 28:
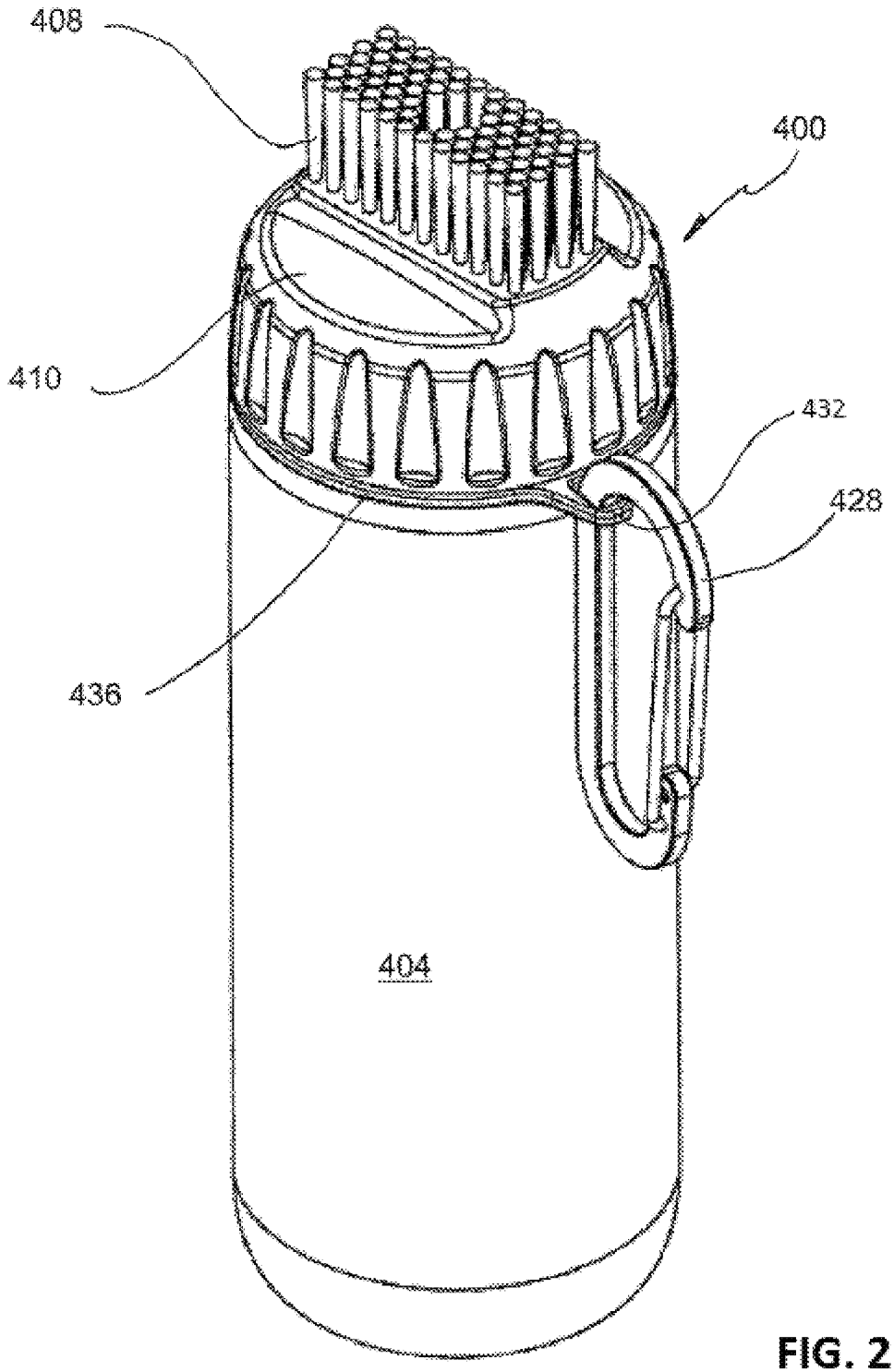
FIG. 28 is a perspective view of another embodiment of the present invention that employs a squeezable bottle.
Figure 29:
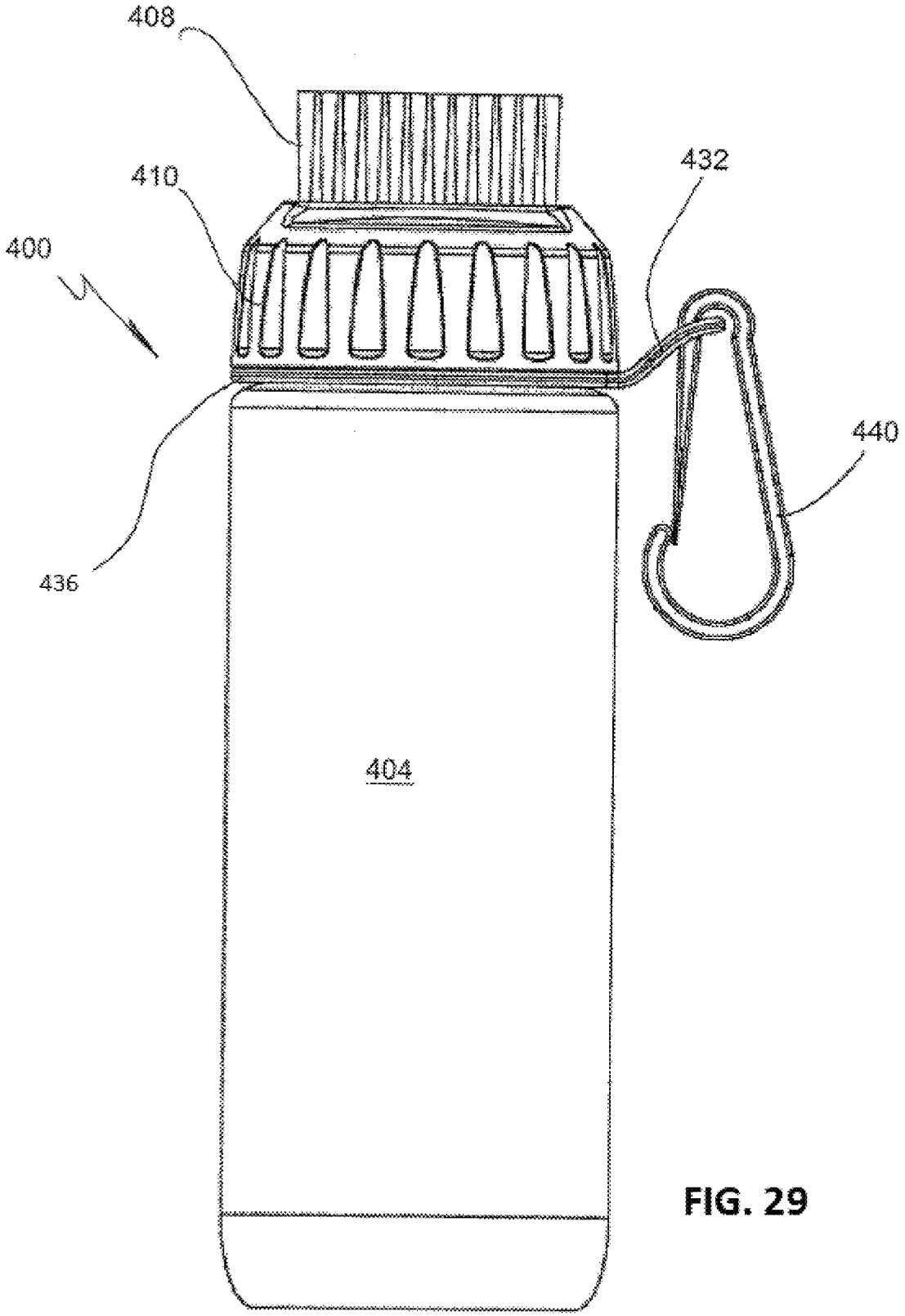
FIG. 29 is a side elevation view of an embodiment similar to that shown in FIG. 28.

FIGS. 28 and 29 show an alternate embodiment of the present invention similar to that shown in FIGS. 16-27, but where a ring 436 is used to provide a retainer 432 that operatively receives a clip 40, for example. The ring 436, which is capable of rotation about the longitudinal axis of the bottle, is positioned between the cap 410 and an upper surface of the bottle 404. Alternatively, the bottle 404 may include a groove that operatively receives the ring 436. In another embodiment, the ring employs at least one inwardly-extending protrusion that interfaces with a corresponding indent on the bottle, wherein the ring is not capable of rotation.

For exemplary purposes only, most embodiments of the present invention described herein have been directed toward golf equipment cleaning devices. However, the present invention should not be limited to only these cleaning devices. The present invention is applicable to any device that may benefit from present invention and the devices described herein. For example, embodiments of the present invention may be utilized on a hot day to cool one's temperature or to clean other sports equipment such as baseball or lacrosse equipment.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about" or "approximately."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

What is claimed is:

1. A cleaning device, comprising:

a container adapted for holding fluid having an opening;

a cap selectively interconnected to the container, the cap further comprising:

a brush extending from an upper surface of the cap, and a valve integrated into an upper opening of the cap, wherein the valve is adapted to selectively open when pressure within the container exceeds a predetermined level;

a sleeve operably interconnected to an outer surface of the container, wherein the sleeve is configured to freely rotate relative to the container; and wherein the sleeve has a rib extending from an inner surface thereof that is received within a groove provided in the container, or wherein the sleeve has a groove in an inner surface thereof that selectively accepts a rib extending from the container.

2. The cleaning device of claim 1, wherein the sleeve includes a retainer adapted to receive a carabiner or clip.

3. The cleaning device of claim 1, wherein the sleeve includes indicia.

4. The cleaning device of claim 1, wherein the container is selectively deflectable.

5. The cleaning device of claim 1, wherein the valve is self-sealable when pressure within the container does not exceed a predetermined level.

6. The cleaning device of claim 5, wherein the valve comprises:

a marginal portion sealing about the cap opening, a head portion including a central area with an orifice that opens to permit fluid flow therethrough in response to a predetermined discharge pressure within the container, and closes to shut off fluid flow therethrough upon removal of the predetermined discharge pressure, and a generally J-shaped connector sleeve having a resiliently flexible construction with a first leg portion thereof connected with the marginal portion, and a second leg portion thereof connected with the head portion; the first and second leg portions being mutually oriented at an acute included angle, and joining one another at an arcuate portion which facilitates movement of the head portion when dispensing product from the container.

7. The cleaning device of claim 1, wherein the valve is self-sealable when pressure within the bottle does not exceed a predetermined level.

8. A cleaning device, comprising:

a flexible bottle having an opening;

a cap selectively interconnected to the bottle and adapted to block the opening, the cap further comprising:

a plurality of bristles extending from an upper surface of the cap, and a valve integrated into an upper opening of the cap, wherein the valve is adapted to selectively open when pressure within the bottle exceeds a predetermined level;

a sleeve operably interconnected to an outer surface of the bottle, wherein the sleeve is configured to freely rotate relative to the bottle; and wherein the sleeve has a rib extending from an inner surface thereof that is received within a groove provided in the container, or wherein the sleeve has a groove in an inner surface thereof that selectively accepts a rib extending from the container.

9. The cleaning device of claim 8, wherein the sleeve includes a retainer adapted to receive a carabiner or clip.

10. The cleaning device of claim 8, wherein the sleeve includes indicia.

11. The cleaning device of claim 8, wherein bottle has a first portion with a first outer extent that is greater than a second portion with a second outer extent, wherein a ledge connects the first portion to the second portion, and wherein a lower end of the sleeve rests on the ledge and an upper edge of the sleeve is positioned adjacent to a lower end of the cap.

12. The cleaning device of claim 11, wherein the sleeve has an outer extent that coincides with the first outer extent.

13. A cleaning device, comprising:

a container adapted for holding fluid having an opening;

a cap selectively interconnected to the container, the cap further comprising:

a brush extending from an upper surface of the cap, and a valve integrated into an upper opening of the cap, wherein the valve is adapted to selectively open when pressure within the container exceeds a predetermined level;

a sleeve operably interconnected to an outer surface of the container, wherein the sleeve is configured to freely rotate relative to the container; and wherein the container has a first portion with a first outer extent that is greater than a second portion with a second outer extent, wherein a ledge connects the first portion to the second portion, and wherein a lower end of the sleeve rests on the ledge and an upper edge of the sleeve is positioned adjacent to a lower end of the cap.

14. The cleaning device of claim 13, wherein the sleeve has an outer extent that coincides with the first outer extent.

* * * * *